United States Patent [19]

Grossmann et al.

[11] Patent Number: 4,695,004

[45] Date of Patent: Sep. 22, 1987

[54] METHOD FOR TRANSFERRING A WEB FROM A FINISHED ROLL TO A NEW CORE, AND DRUM WINDER FOR THE APPLICATION OF THE METHOD

[75] Inventors: Udo Grossmann, Heidenheim; Dieter Holzinger, Herbrechtingen; Guenter Rohde, Zang, all of Fed. Rep. of Germany

[73] Assignee: J. M. Voith GmbH, Heidenheim, Fed. Rep. of Germany

[21] Appl. No.: 790,341

[22] Filed: Oct. 23, 1985

[30] Foreign Application Priority Data

Apr. 30, 1985 [DE] Fed. Rep. of Germany ..... 3515519

[51] Int. Cl.[4] ..... B65H 19/26

[52] U.S. Cl. ..... 242/56 R; 242/56.6

[58] Field of Search ..... 242/56 R, 56 A, 56.2, 242/56.4, 56.6, 65; 83/102, 408

[56] References Cited

U.S. PATENT DOCUMENTS

| | | | |
|---|---|---|---|
| 2,728,532 | 12/1955 | Bower et al. | 242/56 R |
| 3,743,197 | 7/1973 | Hawkins | 242/56.6 |
| 3,756,527 | 9/1973 | Collins et al. | 242/56.6 X |
| 3,764,085 | 10/1973 | Hawkins | 242/56.6 |
| 3,857,524 | 12/1974 | Melead et al. | 242/56 R |
| 4,444,362 | 4/1984 | Karr | 242/56.6 |
| 4,445,646 | 5/1984 | Karr et al. | 242/56 R |
| 4,458,852 | 7/1984 | Calvert et al. | 242/56 A |

FOREIGN PATENT DOCUMENTS

| | | |
|---|---|---|
| 1574307 | 7/1973 | Fed. Rep. of Germany . |
| 2721883 | 11/1978 | Fed. Rep. of Germany . |
| 3212960 | 10/1983 | Fed. Rep. of Germany . |
| 2133051 | 11/1972 | France . |
| 1297812 | 11/1972 | United Kingdom . |

*Primary Examiner*—Stuart S. Levy
*Assistant Examiner*—David Werner
*Attorney, Agent, or Firm*—Jeffers, Hoffman & Niewyk

[57] ABSTRACT

A method for transferring a continuously arriving web, specifically a paper or cardboard web, from a finished product roll to a new core rotating at the speed of web travel. The new core bears in the direction of web travel and before the finished product roll on a drum around which loops the web. The web is cut longitudinally, prior to running on the drum, for forming a transfer strip. Before reaching the new core, the transfer strip is severed from the advancing web and passed onto the new core. The web is subsequently cut across its entire width, wherein this cut originates from the longitudinal cut.

A drum winder for accomplishing the method wherein the severing device for the transfer strip is arranged before the intake gap between the drum and the new core. A high-pressure water jet is used for severing the transfer strip from the web.

11 Claims, 3 Drawing Figures

METHOD FOR TRANSFERRING A WEB FROM A FINISHED ROLL TO A NEW CORE, AND DRUM WINDER FOR THE APPLICATION OF THE METHOD

BACKGROUND OF THE INVENTION

The invention concerns a method for transferring a continuously arriving web, such as a paper or cardboard web, from a finished roll on a new core rotating at the travel speed of the web, and a drum winder for carrying out said method.

A method of transferring a continuously arriving web and corresponding drum winder are previously known from the U.S. Pat. No. 4,445,646. The transfer strip is produced there in the center of the web by two parallel cuts. The transfer strip is simultaneously perforated through an incision which occurs approximately crosswise to the direction of web travel, but the strip continues to be connected with the web leader. As the transfer strip approaches the gap between the drum and the new core, the blades serving to produce the strip advance in the direction of the respective adjacent web edge so that the remaining web will be severed. As the transfer strip passes through the gap between the drum and the new core, a compressed air jet impinges on the web and this is supposed to completely sever the transfer strip in the perforated area from the web leader and guide it around the new core. Upon completed transfer of the web leader to the new core, the finished roll is removed from the drum and the new core takes its place. The prior winding method is suitable only for webs having a low basis weight and/or low strength. For webs having a high basis weight and/or high strength, a compressed air jet is not sufficiently effective to dependably separate the transfer strip from the advancing web.

The German Patent Disclosure No. 27 21 883 suggest to sever the transfer strip leaving the gap with the aid of a knife, but this requires the knife to engage the web looping around the drum entailing necessary damage to the drum surface. An unsuccessful transfer process results in a considerable web loss because a new transfer attempt can be initiated only after the knives of the cutoff device have returned to their home position. In the meantime, however, the web approaching the drum at high speed continues to wind on the roll. Thus, once the roll change has been completed, several web layers must be peeled off the finished roll so as to remove the web area which was cut up during the unsuccessful transfer attempt.

SUMMARY OF THE INVENTION

The problem underlying the invention is to accomplish a dependable transfer of the new web leader, especially with high strength and/or heavy webs, on a new core and to provide a suitable winder for that purpose. In view of the inventional method, for one, this problem is solved through severing the transfer strip from the advancing web before reaching the new core and, for another, through providing the initially mentioned drum winder with a severing device for the transfer strip that is arranged before the intake gap between the drum and the new core.

The solution concerning the method is characterized in that the transfer strip, which has been severed from the advancing web already before the intake gap across its entire width, can be grabbed and transferred to the new core in a much simpler manner and much more dependably as it leaves the gap. In the process, any high tear resistance of the web is nonessential. Even a transfer strip which is heavier in terms of basis weight, and thus, possesses a certain stiffness, can be dependably transferred to the new core.

The advancement of the method of the invention wherein the transfer strip is severed by means of a high-pressure water jet which can be moved at least approximately transverse to the direction of web travel achieves also with heavy and strong webs an effective separation of the transfer strip. Besides, a deflection or bounce of the strip is avoided since no mechanical parts are in contact with the transfer strip.

With the transfer strip being completely severed from the advancing web, the advancement of the method of the invention wherein the severed transfer strip is guided by an airblast into the intake gap formed by the new core and the drum safeguards that the strip will follow the path of the web into the intake gap.

The solution of the above problem relating to the drum winder offers the advantage that the distance over which the transfer strip end no longer has a connection with the advancing web is as short as possible. As previously mentioned, it is also assured that a transfer strip which is already separated from the advancing web will pass through the intake gap and can be transferred on the new core.

The presence in the severing device of at least one nozzle, for discharging a high-pressure water jet, which is movable at least approximately transverse to the direction of web travel avoids wear due to mechanical contact between parts of the cutoff device and the web.

Through providing a water jet absorbtion device opposite the nozzle, the jet is rendered ineffective after passing through the web, for safety reasons.

Dependable guidance of the strip toward the intake gap is accomplished by providing a guide device supporting the strip at least on one side that is arranged between the severing device for the transfer strip and the intake gap. The guide device is produced at low expense, i.e., with few components, since it features blast nozzles directed at the intake gap.

The above-mentioned and other features and objects of this invention and the manner of attaining them will become more apparent and the invention itself will be best understood by reference to the following description of an embodiment of the invention taken in conjunctin with the accompanying drawings.

DESCRIPTION OF A SPECIFIC EMBODIMENT

Figure 1:
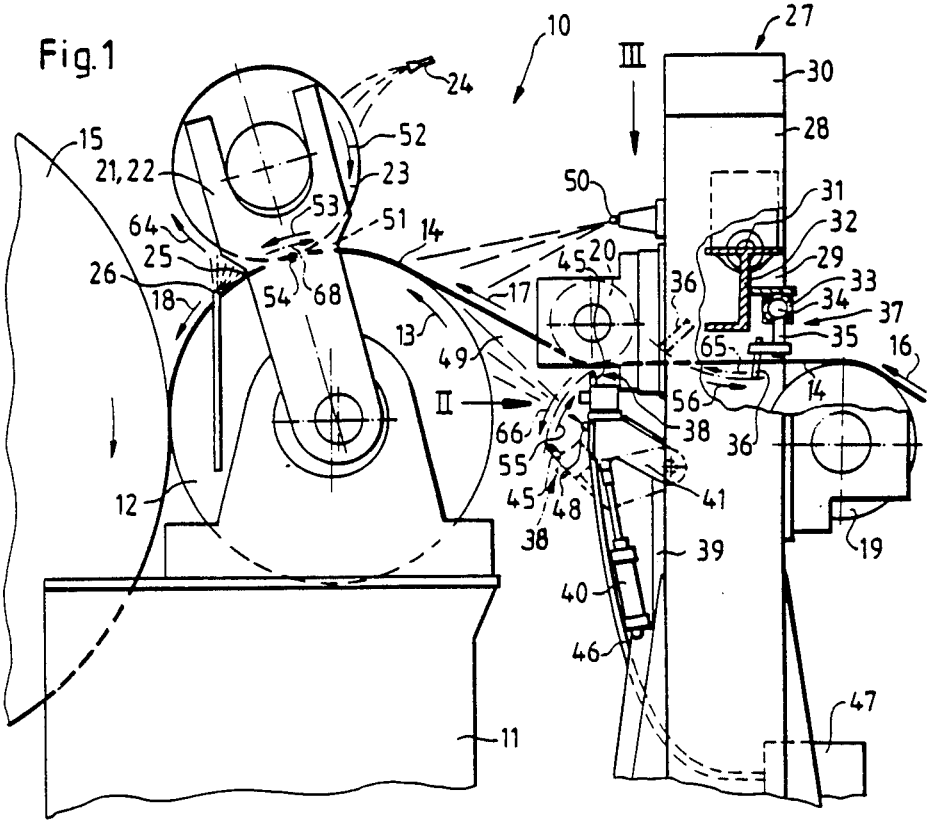
FIG. 1 shows a side elevation of a drum winder for winding web from which a transfer strip is being cut with a cutter device.

Referring to the drawings, the drum winder is generally designated as 10, and features a drum 12 mounted on a machine frame 11 and powered in the direction of arrow 13 (FIG. 1). The drum winder 10 serves to wind a web 14 produced in a cardboard machine (not illustrated) on a roll 15 which bears radially on the drum 12. The web 14 travels in the direction of arrows 16, 17 and 18 across a guide roll 19 and a spreader roll 20 across the upper circumferential area of the drum 12 and on to the product roll 15. Also mounted on the machine frame 11 are two single-arm levers 21, 22 which are located successively in the drawing plane and serve the placement of a new core 23 on the drum 12. Coordinated with the front end of the core 23 is a water spray nozzle 24. Also provided at the leaving gap 25 between the drum 12 and the new core 23, up front, is a nozzle 26 for discharging compressed air tangentially across the web 14 opposite to its direciton of travel and at the circumference of the core 23.

Viewed in the direction of web travel, a gantry generally designated as 27 comprises two successive posts 28, 29 located in the drawing plane precede the machine frame 11 and connected with each other by a crossmember 30. The web 14 passes between the two posts 28, 29 on which the two rolls 19 and 20 are mounted. In addition, a beam 32 which swivels on the axle 31 is mounted between the two posts 28, 29. This beam 32 supports a pneumatic cylinder 33 extending transverse to the web and comprising no piston rod. The piston 34 of cylinder 33 features a stud 35. The stud 35 protrudes downward toward the web 14, out of the cylinder 33 having approximately the width of the web, and supports a knife 36 which swivels about the stud axis. The knife 36 and its drive form a cutting device 37 for the web 14.

Provided between the two posts 28, 29 is a severing device 38 which in the direction of travel of the web 14 is located behind the cutting device 37. There is provided a support 39 on which a beam 41 (FIG. 2) is mounted which extends underneath the spreader roll 20 and can be operated by a swivel cylinder 40. Mounted on the beam 41 is a power cylinder 42 whose piston rod 43 is connected with a guide rod 44 extending parallel with the spreader roll 20 and having a nozzle 45 attached to it. The nozzle 45, coordinated with the front edge area of the web 14, connects through a flexible line 46 with a high-pressure pump 47 for discharging a high-pressure water jet. In addition, a nozzle 48 is arranged on the beam 41 for discharging compressed air in the front gap 49 between the web 14 and the drum 12 (FIG. 1). Moreover, a second nozzle 50 is provided above the spreader roll 20, on the post 28, for discharging compressed air on the topside of the front area of the web 14 and into the intake gap 51 of the web 14 between the drum 12 and the new core 23. The two nozzles 48 and 50 serve to guide the leading web section as the web 14 is transferred from the finished product roll 15 to the new core 23.

The operation of the drum winder is now described as follows:

Once the product roll 15 has reached its finishe size, it is necessary to transfer the web 14 arriving continuously from the cardboard machine onto the new core 23. For that purpose, the new core 23 has been in sufficient time previously inserted into the forked upright levers 21, 22 and accelerated, in the direction of arrow 52, to a peripheral speed equaling the speed of web travel. Subsequent to it, the core 23 has been placed on the drum 12 looped by the web, by swiveling the support levers 21, 22 mounted eccentrically to the drum 12, in the direction of arrow 53. In this position of the core 23, as presented in FIG. 1, the core 23 bears before the finished roll 15, viewed in the direction of web travel, through the intermediary of the web 14 and along a contact line 54 on the drum 12.

The knife 36 of the cutting device 37 is still in a waiting position indicated by dash-dotted lines, behind the web 14 edge away from the front. Shortly before completing the finished roll diameter, compressed air is admitted in the cylinder 33 which then moves the knife 36 toward the front edge of the web 14. The stroke of the piston 34 is terminated before the web 14 front edge so that the knife 36 assumes a position of readiness just above the web 14 and about 20 cm from its front edge.

Simultaneously or immediately subsequent to the knife 36 assuming its position of readiness, the severing device 38 underneath the spreader roll 20 is swiveled out of its waiting position indicated by dash-dotted lines in FIG. 1, by operation of the swivel cylinder 40, into its position of readiness indicated by solid lines, in the direction of arrow 55. The nozzle 45 is spaced 20 cm (FIG. 2) from the front edge of the web 14, that is, the same distance as the knife 36 of the cutting device 37. The nozzle 45 is then located exactly opposite the spreader roll 20 at about 10 mm distance from the web 14.

Figure 2:
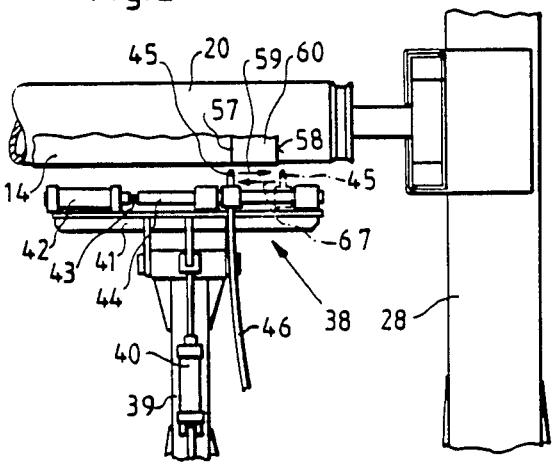
FIG. 2 is a view of the cutter device, viewed in the direction of arrow II in FIG. 1.
Figure 3:
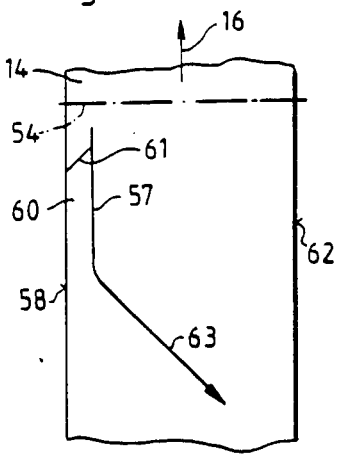
FIG. 3 is a section of the web with the severed transfer strip, viewed in the direction of arrow III in FIG. 1 and turned 90° clockwise.

When the finished roll diameter is reached, the knife 36 of the cutting device 37 moves in the direction of arrow 56, by swiveling the beam 32 with the aid of the not illustrated swivel drive, and assumes the position indicated by solid lines in FIG. 1. There is now produced in the web 14 arriving in the direction of arrow 16 a longitudinal cut 57 which is spaced 20 cm from the front edge 58 of the web and parallel with it (see FIG. 3). Once the longitudinal cut 57 has advanced to the spreader roll 20, a high-pressure water jet is discharged from the nozzle 45. Compressed air is simultaneously admitted to the power cylinder 42 moving the nozzle 45, which is movable transverse to the direction of web travel, from its position of readiness to its end position indicated by dash-dotted lines (FIG. 2), in the direction of arrow 59. A transfer strip 60 produced by the longitudinal cut 57 is severed from the advancing web 14 (FIG. 3) by severing cut 61 which is effected by the water jet. Penetrating the web 14 while severing it, the water jet is absorbed and neutralized by the opposite spreader roll 20. Coinciding with operating the severing device 38, compressed air 50 discharges from the nozzles 48 and 50, thus dependably guiding the transfer strip 60, now completely severed from the advancing web 14, into the intake gap 51 between the new core 23 and the drum 12 (FIG. 1). Next, compressed air is admitted to the cylinder 33 of the cutting device 37, moving the piston 34 toward the rear post 29. The knife 36 performs in the process a movement toward the web 14 edge 62 remote from the front, thus severing the web by a diagonal cut 63, originating from the longitudinal cut 57, across its entire width (FIG. 3). In this context it should be noted that the diagonal direction of the severing cut 61 and the latter cut 63 come about through superimposition of the knife 36 movement transverse to the direction of web travel and of the nozzle 45 with the movement of web 14 in the direction 16.

Before or during performing the diagonal cut 63, the point of the transfer strip 60 has reached the contact line 54 between the drum 12 and the new core 23. The compressed air discharged by the previously activated nozzle 26 reaches under the transfer strip 60 leaving the gap 25 on the departure side and loops it around the new core 23 in the direction of arrow 64. Spraying the new core 23 with water from the nozzle 24 promotes the adhesion of the transfer strip 60 to the core. Once the transfer strip 60 has looped around the core 23, the knife 36 has advanced out of the web 14 beyond its edge 62 on the side remote from the front end. The advancing web being fed to the product roll 15 is thus completely severed through the longitudinal cut 57, severing cut 61 and the diagonal cut 63. The web following the transfer strip 60 runs now at full width on the new core 23.

Upon shutoff of the water spray nozzle 24 and the compressed air nozzles 26, 48 and 50, the knife 36 of the cutting device 37 is swiveled into its waiting position indicated by dash-dotted lines, in the direction of arrow 65. The severing device 38 is also swiveled into its position indicated by dash-dotted lines (FIG. 1) by means of the swivel cylinder 40, in the direction of arrow 66, and is subsequently moved by the power cylinder 42, transverse to the web, to its home position in the direction of arrow 67 (FIG. 2). The finished product roll 15 is removed radially from the drum 12, braked down and lifted from the winder 10. The placement levers 21, 22 are swiveled in the direction of arrow 53 so that the new core 23, onto which the web 14 runs continuously, can assume the position (place) of the finished roll 15. Once the placement levers 21, 22 are freed from the core 23 as the product roll grows they are swiveled upward in the direction of arrow 68 for receiving a new core.

The specific embodiment may be modified wherein it is also possible to perform the severing cut 61 so as to originate from the front edge 58 of the web 14 and continue toward the longitudinal cut 57. In accordance with the initially mentioned U.S. Pat. No. 4,445,646, the transfer strip 60 can be placed also in the center of the web 14, then requiring two appropriately arranged cutting devices 37. It is also conceivable to cut on both edges 58 and 62 of the web 14 a transfer strip 60 each simultaneously. The diagonal cuts 63 converge then in the center of the web.

While there have been described above the principles of this invention in connection with specific apparatus, it is to be clearly understood that this description is made only by way of example and not as a limitation to the scope of the invention.

What is claimed is:

1. A method for transferring a continuously arriving web from a finished product roll onto a new core rotating at the speed of web travel and bearing in the direction of web travel in front of the finished product roll on a drum looped by the web comprising: cutting the web longitudinally for forming a transfer strip prior to running onto the drum, said transfer strip remaining attached to the portion of the advancing web to be wound on the finished product roll, subsequently severing the transfer strip from said portion of the advancing web before the transfer strip reaches the new core, guiding the transfer strip onto the new core, and, only after the transfer strip is onto the new core, severing the web originating from the longitudinal cut across its entire width.

2. The method according to claim 1 wherein the transfer strip is severed by means of a high-pressure water jet which can be moved at least approximately transverse to the direction of web travel.

3. The method according to claim 1 wherein the severed transfer strip is guided by an air blast into the intake gap formed by the new core and the drum.

4. The method according to claim 2 wherein the severed transfer strip is guided by an air blast into the intake gap formed by the new core and the drum.

5. In a drum winder for the transfer of a continuously arriving web from a finished product roll onto a new core having a powered drum looped by the web, a finished product roll bearing on the powered drum and the new core rotating in the direction of web travel and positioned before the product roll, the drum winder comprising: cutting means positioned before the powered drum for cutting the web longitudinally for forming a transfer strip prior to running onto the drum but leaving the transfer strip attached to the portion of the advancing web to be wound on the finished product roll, severing means, positioned downstream of said cutting means and before the intake gap between the drum and the new core, for severing the transfer strip from said advancing web portion before the transfer strip reaches the new core, and guide means for guiding the severed transfer strip onto the new core, said cutting means including the means for completely severing the web after the severed transfer strip is guided onto the new core.

6. The drum winder according to claim 5 wherein said severing means includes at least one nozzle for discharging a high-pressure water jet and which is movable at least approximately transverse to the direction of web travel.

7. The drum winder according to claim 6 further including an absorbtion device for absorbing the water jet, said absorbtion device being located opposite said nozzle.

8. The drum winder according to claim 5 wherein a guide assembly that supports the strip at least on one side is arranged between the severing means and the intake gap.

9. The drum winder according to claim 8 wherein the guide assembly includes blast nozzles directed at the intake gap.

10. The drum winder according to claim 6 wherein a guide assembly that supports the strip at least on one side is arranged between the severing means and the intake gap.

11. The drum winder according to claim 10 wherein the guide assembly includes blast nozzles directed at the intake gap.

* * * * *

UNITED STATES PATENT AND TRADEMARK OFFICE

CERTIFICATE OF CORRECTION

PATENT NO. : 4,695,004

DATED : September 22, 1987

INVENTOR(S) : Udo Grossman et al

It is certified that error appears in the above-identified patent and that said Letters Patent is hereby corrected as shown below:

Col. 2, line 48, change "conjunctin" to --conjunction--;
Col. 3, line 11, change "direciton" to --direction--;
Col. 3, line 54, change "finishe" to --finished--;
Claim 5, Col. 6, line 30, delete "the" first occurrence.

Signed and Sealed this

Second Day of February, 1988

*Attest:*

*Attesting Officer*

DONALD J. QUIGG

*Commissioner of Patents and Trademarks*